US006311697B1

(12) United States Patent
Gibson

(10) Patent No.: US 6,311,697 B1
(45) Date of Patent: Nov. 6, 2001

(54) HAIR STYLING DEVICE

(76) Inventor: Theodore Gibson, 114 E. 11th St., #1E, New York, NY (US) 10003

( * ) Notice: Subject to any disclaimer, the term of this patent is extended or adjusted under 35 U.S.C. 154(b) by 29 days.

(21) Appl. No.: 09/637,668

(22) Filed: Aug. 14, 2000

(51) Int. Cl.[7] ..... A45D 7/00
(52) U.S. Cl. ..... 132/210
(58) Field of Search ..... 132/200, 210, 132/273, 212, 245, 248, 250, 275, 280; D28/32, 39; 223/99

(56) References Cited

U.S. PATENT DOCUMENTS

| | | | | |
|---|---|---|---|---|
| 66,599 | * | 7/1867 | McMillan | 132/248 |
| 1,707,392 | * | 4/1929 | Fulton | 132/248 |
| 2,630,810 | * | 3/1953 | Solomon | 132/250 |
| 4,667,860 | * | 5/1987 | Feuerman | 223/99 |
| 5,036,870 | | 8/1991 | Edmark . | |
| 5,097,854 | * | 3/1992 | Smith | 132/275 |
| 5,289,834 | | 3/1994 | Lawrence . | |
| 5,293,884 | | 3/1994 | Chapman et al. . | |
| 5,499,638 | | 3/1996 | Ripley . | |

FOREIGN PATENT DOCUMENTS

| | | | | |
|---|---|---|---|---|
| 558843 | * | 6/1958 | (CA) | 132/248 |
| 55263 | * | 1/1952 | (FR) | 132/248 |
| 362378 | * | 11/1931 | (GB) | 132/250 |

* cited by examiner

*Primary Examiner*—Jeffrey A. Smith
*Assistant Examiner*—Eduardo C. Robert
(74) *Attorney, Agent, or Firm*—Goldstein Law Offices P.C

(57) ABSTRACT

A hair styling device including an elongated bamboo stick having a tapered first end and a second end. The second end has an aperture directed therethrough. An elastic band is secured to the second end of the elongated bamboo stick through the aperture thereof. The length of hair is positioned through the elastic band and the length of hair is twisted around itself and then the tapered first end of the elongated bamboo stick slides into the twisted length of hair.

1 Claim, 2 Drawing Sheets

Fig. 2
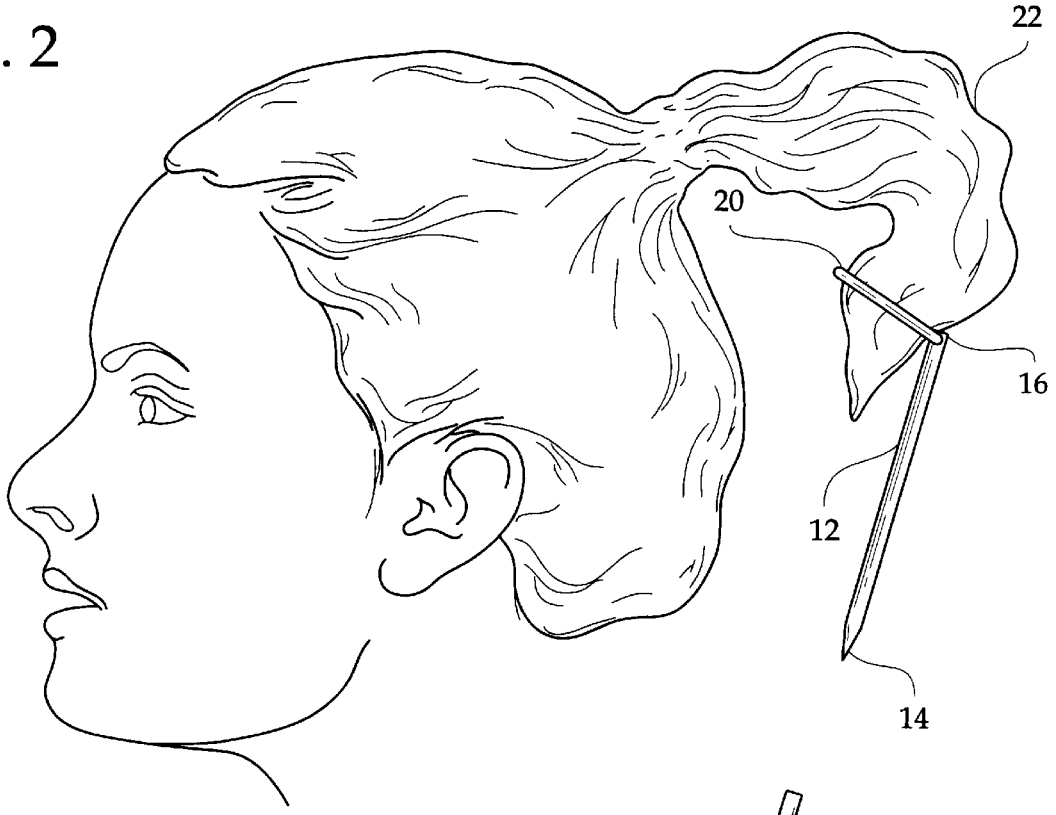
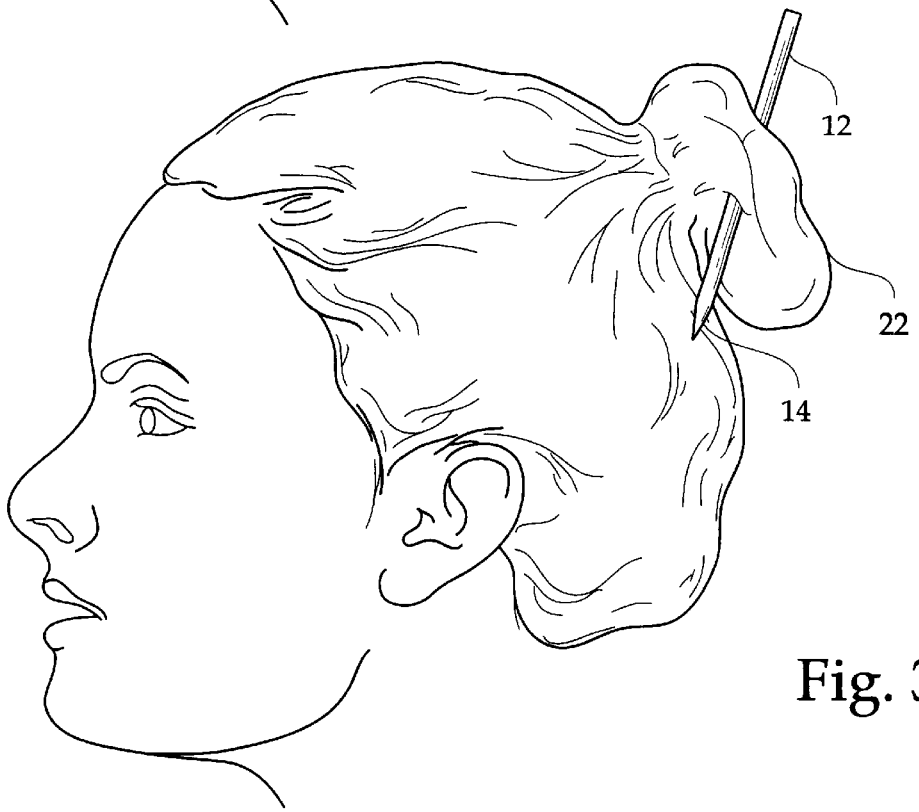
Fig. 3

HAIR STYLING DEVICE

BACKGROUNND OF THE INVENTION

The present invention relates to a hair styling device and more particularly pertains to allowing a length of hair to be twisted into a bun.

The use of hair styling implements is known in the prior art. More specifically, hair styling implements heretofore devised and utilized for the purpose of styling hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,036,870 to Edmark discloses a tool comprised of a probe and loop for inverting a hair tail. U.S. Pat. No. 5,289,834 to Lawrence discloses a tool comprised of a loop for treading a pony tail type hair style. U.S. Pat. Nos. 5,499,638 to Ripley and 5,293,884 to Chapman disclose additional hair styling accessories.

While these devices fulfill their respective, particular objective and requirements, the aforementioned patents do not describe a hair styling device for allowing a length of hair to be twisted into a bun.

In this respect, the hair styling device according to the present invention substantially departs from the conventional concepts and designs of the prior art, and in doing so provides an apparatus primarily developed for the purpose of allowing a length of hair to be twisted into a bun.

Therefore, it can be appreciated that there exists a continuing need for a new and improved hair styling device which can be used for allowing a length of hair to be twisted into a bun. In this regard, the present invention substantially fulfills this need.

SUMMARY OF THE INVENTION

In the view of the foregoing disadvantages inherent in the known types of hair styling implements now present in the prior art, the present invention provides an improved hair styling device. As such, the general purpose of the present invention, which will be described subsequently in greater detail, is to provide a new and improved hair styling device which has all the advantages of the prior art and none of the disadvantages.

To attain this, the present invention essentially comprises an elongated bamboo stick having a tapered first end and a second end. The second end has an aperture directed therethrough. An elastic band is secured to the second end of the elongated bamboo stick through the aperture thereof. The length of hair is positioned through the elastic band and the length of hair is twisted around itself and then the tapered first end of the elongated bamboo stick slides into the twisted length of hair.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair styling device which has all the advantages of the prior art hair styling implements and none of the disadvantages.

It is another object of the present invention to provide a new and improved hair styling device which may be easily and efficiently manufactured and marketed.

It is a further object of the present invention to provide a new and improved hair styling device which is of durable and reliable construction.

An even further object of the present invention is to provide a new and improved hair styling device which is susceptible of a low cost of manufacture with regard to both materials and labor, and which accordingly is then susceptible of low prices of sale to the consuming public, thereby making such a hair styling device economically available to the buying public.

Even still another object of the present invention is to provide a new and improved hair styling device for allowing a length of hair to be twisted into a bun.

Lastly, it is an object of the present invention to provide a new and improved hair styling device including an elongated bamboo stick having a tapered first and end a second end. The second end has an aperture directed therethrough. An elastic band is secured to the second end of the elongated bamboo stick through the aperture thereof. The length of hair is positioned through the elastic band and the length of hair is twisted around itself and then the tapered first end of the elongated bamboo stick slides into the twisted length of hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side view of the present invention illustrated in use.

FIG. 3 is a side view of the present invention illustrated within a finished product.

The same reference numerals refer to the same parts through the various FIGS.

DESCRIPTION OF THE PREFERRED EMBODIMENT

Figure 1:
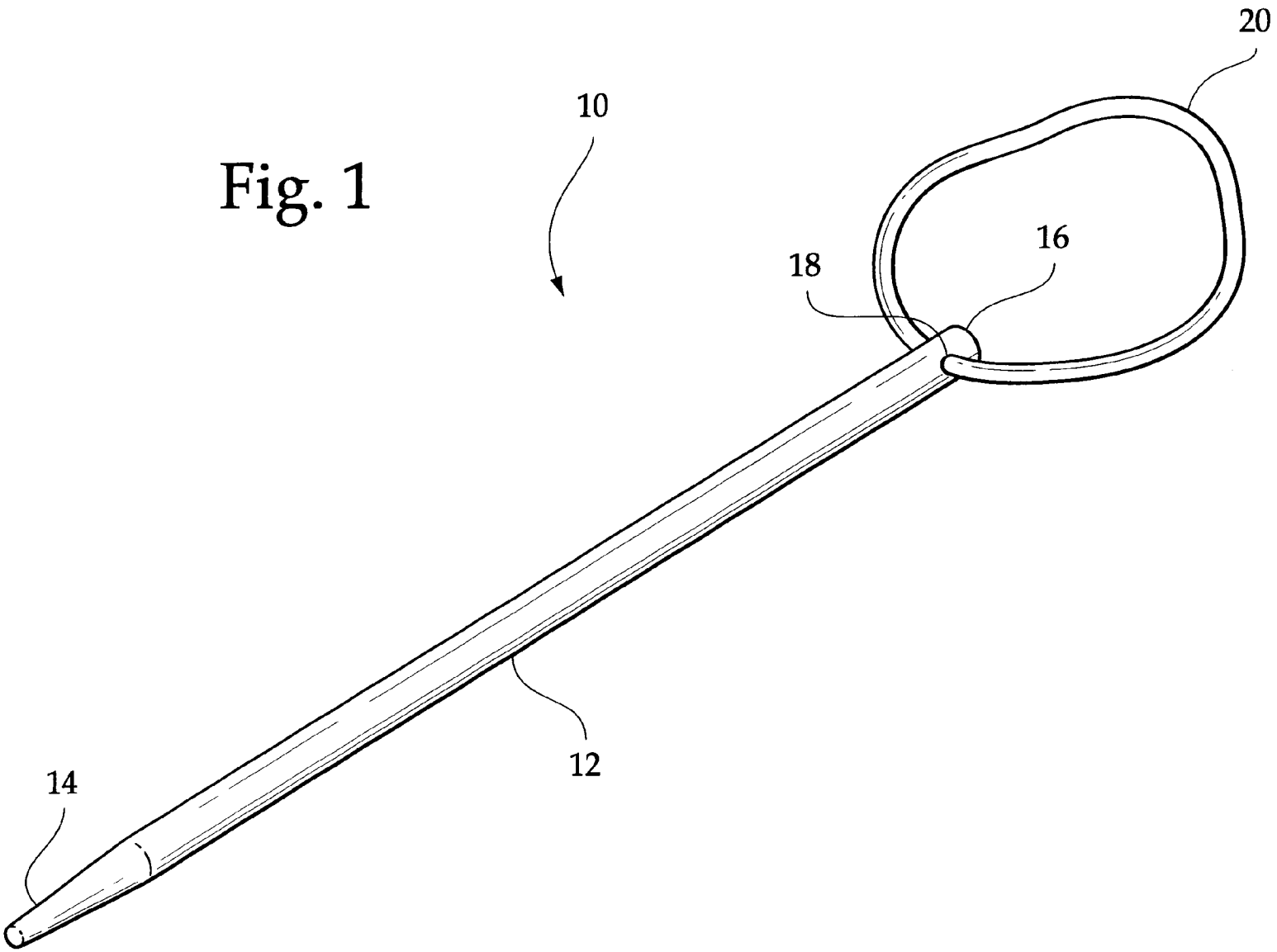
FIG. 1 is a perspective view of the preferred embodiment of the hair styling device constructed in accordance with the principles of the present invention.

With reference now to the drawings, and in particular, to FIGS. 1 through 3 thereof, the preferred embodiment of the new and improved hair styling device embodying the principles and concepts of the present invention and generally designated by the reference number 10 will be described.

Specifically, it will be noted in the various figures that the device relates to a hair styling device for allowing a length of hair to be twisted into a bun. In its broadest context, the device consists of an elongated bamboo stick and an elastic band. Such components are individually configured and correlated with respect to each other so as to attain the desired objective.

The present invention is designed for twisting a length is of hair into a bun using the elongated bamboo stick and the elastic band.

The elongated bamboo stick 12 has a tapered first end 14 and a second end 16. The second end 16 has an aperture 18 directed therethrough.

The elastic band 20 is secured to the second end 16 of the elongated bamboo stick 12 through the aperture 18 thereof.

The length of hair 22 is positioned through the elastic band 20 (note FIG. 2) and the length of hair 22 is twisted around itself and then the tapered first end 14 of the elongated bamboo stick 12 slides into the twisted length of hair 22 to form the bun. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method for allowing a length of hair to be twisted into a bun comprising, in combination:

providing an elongated bamboo stick having a tapered first end and a second end, the second end having an aperture directed therethrough;

providing an elastic band secured to the second end of the elongated bamboo stick through the aperture thereof; and wherein the length of hair is positioned through the elastic band and the length of hair is twisted around itself and then the tapered first end of the elongated bamboo stick slides into the twisted length of hair.

* * * * *